United States Patent [19]

Fujii et al.

[11] 4,291,758

[45] Sep. 29, 1981

[54] PREPARATION OF BOILING HEAT TRANSFER SURFACE

[75] Inventors: Masao Fujii; Yoshifusa Ogawa; Yoshiyuki Morihiro, all of Amagasaki, Japan

[73] Assignee: Mitsubishi Denki Kabushiki Kaisha, Tokyo, Japan

[21] Appl. No.: 81,438

[22] Filed: Oct. 3, 1979

[30] Foreign Application Priority Data

Oct. 31, 1978 [JP] Japan ..... 53-135979

[51] Int. Cl.[3] ..... F28F 13/18

[52] U.S. Cl. ..... 165/133; 62/527; 165/DIG. 10

[58] Field of Search ..... 62/527; 165/133, DIG. 10

[56] References Cited

U.S. PATENT DOCUMENTS

| | | | |
|---|---|---|---|
| 3,161,478 | 12/1964 | Chessin | 165/DIG. 10 |
| 3,384,154 | 5/1968 | Milton | 62/527 |
| 3,990,862 | 11/1976 | Dahl et al. | 62/527 |
| 4,064,914 | 12/1977 | Grant | 165/133 |
| 4,120,994 | 10/1978 | Inoue | 165/133 |
| 4,182,412 | 1/1980 | Shum | 62/527 |

FOREIGN PATENT DOCUMENTS

| | | | |
|---|---|---|---|
| 49-47349 | 12/1974 | Japan | 165/133 |
| 49-47350 | 12/1974 | Japan | 165/133 |
| 51-18357 | 2/1976 | Japan | 165/133 |

*Primary Examiner*—Sheldon J. Richter

*Attorney, Agent, or Firm*—Oblon, Fisher, Spivak, McClelland & Maier

[57] ABSTRACT

A boiling heat transfer surface for heat transfer between a heat source and a coolant is provided. On the heat transfer surface contacting with a liquid coolant such as fluorinated hydrocarbon type liquid coolants, metallic particles having grain size of 60 mesh pass and 250 mesh nonpass (Japanese Industrial Standard sieve) are piled up and fixed by a metallic film on the heat transfer surface.

3 Claims, 6 Drawing Figures

PREPARATION OF BOILING HEAT TRANSFER SURFACE

BACKGROUND OF THE INVENTION

1. Field of the Invention

The present invention relates to an improvement of a heat transfer surface for heat transfer between a heat source and a coolant.

2. Description of the Prior Arts

The heat transfer using a boiling liquid coolant will be illustrated.

As it is well-known, the heat quantity Q (Kcal/h) transferred from heat transfer surface to the liquid contacted with the heat transfer surface can be given by the equation:

$$Q=\alpha \cdot A \cdot \Delta T \quad (1)$$

wherein $\alpha$ designates a heat transfer coefficient (Kcal/m.$^2$h.°C.) given by boiling; A designates a surface area (m$^2$) of the heat transfer surface; and $\Delta T$ designates a temperature difference between a surface temperature Tw(°C.) of the heat transfer surface and a temperature T(°C.) of the liquid.

The heat transfer surface having good heat transfer characteristics means the heat transfer surface which transfers large heat quantity Q from the heat transfer surface to the liquid in a small temperature difference $\Delta T$. Thus, the heat transfer surface having large value of $\alpha$ x A is the heat transfer surface having good heat transfer characteristics in view of the equation (1).

Heretofore, in order to increase the heat transfer surface area A, fins have been formed on the heat transfer substrate or a rough surface has been formed by a sandblast.

In order to increase the heat transfer coefficient $\alpha$, a porous surface has been used from the following viewpoint.

The heat transfer in the boiling phenomenon is controlled by the behavior of the liquid in the local region near the heat transfer surface. The boiling heat transfer coefficient $\alpha$ is remarkably greater than that of the convection heat transfer having no phase change without forming steam, because of the stirring effect caused by bubbling of steam generated and leaving from the heat transfer surface and the latent heat transfer effect. For example, the forced convection heat transfer coefficient of air can be only several tens to several hundreds (Kcal/m.$^2$h.°C.) whereas the boiling heat transfer coefficient of water can be several thousands to several ten thousands (Kcal/m.$^2$h.°C.). The steam bubbles are formed by boiling the liquid contacted with the heat transfer surface. When the steam bubbles are generated and left from the heat transfer surface, fresh liquid should be fed on the heat transfer surface. Otherwise, the heat transfer surface is dried to be covered with the steam whereby a film boiling condition is caused and the heat transfer coefficient $\alpha$ is suddenly decreased. Thus, in order to increase the boiling heat transfer coefficient $\alpha$, the number for bubble forming points on the heat transfer surface should be increased and the smooth feeding of the liquid on the heat transfer surface should be given. On a porous surface, the steam in many cavities results bubble nuclei and the cavities are connected in the porous layer, fresh liquid is fed to the bubble nuclei. Thus, the heat transfer coefficient $\alpha$ can be increased.

FIG. 1 shows the heat transfer surface considered by the conventional consideration. A porous layer (3) is formed on the surface of the smooth heat transfer substrate by sintered metal (1). The porous heat transfer surface (4) is formed by the porous layer (3). On the porous heat transfer surface (4), many cavities (5) are formed in the porous layer (3) and the steam is kept in the cavities (5). It is necessary to form bubble nuclei in order to generate steam bubbles from the heat transfer surface and to leave into the liquid (6). In the porous surface, the steam in the cavities (5) can be bubble nuclei. The bubble nuclei are grown by the heating of the heat transfer surface so as to form steam bubbles.

On the smooth heat transfer surface, the bubble nuclei may be in scratches or cracks on the smooth heat transfer surface. The number of scratches or cracks is remarkably smaller than the number of bubble nuclei in the porous heat transfer surface (4). Thus, the formation of the steam bubbles is small whereby the heat transfer coefficient $\alpha$ is remarkably smaller than that of the porous heat transfer surface (4).

On the porous heat transfer surface (4), cavities (5) are connected in the porous layer (3). When local active bubbling nuclei are formed, the fresh liquid is continuously fed from the other poor bubbling centers to the local active bubbling nuclei. The feeding of the fresh liquid is promoted by capillary effect in the porous layer (3).

The porous heat transfer surface (4) has the abovementioned advantages to be suitable as a boiling heat transfer surface. However, the preparation of the conventional porous heat transfer surface (4) using the sintered metal (1) is not easy. That is, in the preparation, metal particles are mixed with a binder such as phenol resin and the mixture is coated on the surface of the heat transfer substrate (2) and they are heated at high temperature to sinter the metal particles on the surface of the heat transfer substrate (2) and it is further heated to remove the binder by a reduction after the sintering.

Thus, in the preparation of the conventional porous heat transfer surface, the control of the atmosphere in the sintering or the control of the binder is not easy. Moreover, the metal particles are melt-bonded and accordingly, the structure of the porous layer is complicated. The complicated process control is disadvantageously required in a mass production of uniform products.

SUMMARY OF THE INVENTION

It is an object of the present invention to overcome the disadvantages of the conventional heat transfer surface and to provide a heat transfer surface having excellent heat transfer characteristics which is prepared by placing particles having suitable grain size and forming a metallic film by a plating etc. on the particle layer to hold the particles on the heat transfer surface.

The heat transfer surface for contacting with a coolant such as fluorinated hydrocarbon type coolants e.g. Freon is prepared by placing the metallic particles having grain sizes of 60 mesh pass and 250 mesh nonpass (Japanese Industrial Standard sieve) and forming a metallic film on the metallic particle layer by a nickel plating etc. to bond the metallic particles on the heat transfer surface. The thickness of the metallic film is preferably in a range of 10 $\mu$m to 100 $\mu$m.

The boiling heat transfer surface of the present invention has a ratio $\alpha/\alpha_o$ of about 4 to 10 wherein $\alpha$ designates a heat transfer coefficient of the resulting heat transfer surface and $\alpha_o$ designates a heat transfer coefficient of a smooth heat transfer surface.

DETAILED DESCRIPTION OF THE PREFERRED EMBODIMENTS

Figure 1:
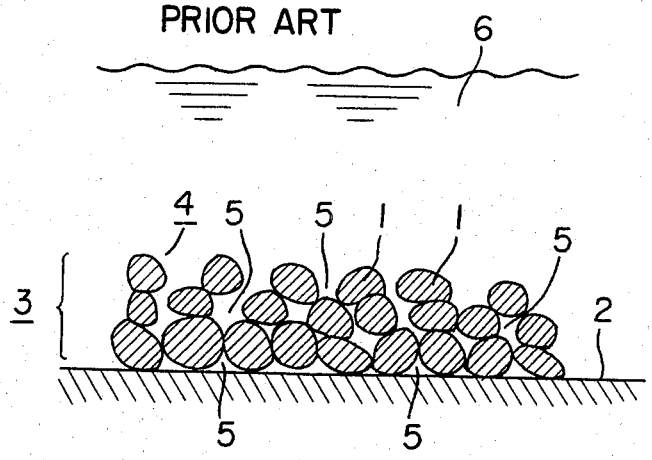
FIG. 1 PRIOR ART
FIG. 1 is a schematic view of a conventional porous heat transfer surface.
Figure 2:
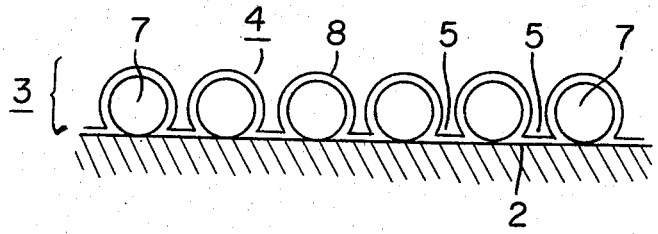
FIG. 2 is a porous heat transfer surface of the present invention.

FIG. 2 shows one embodiment of the present invention. In this embodiment, a porous layer (3) is formed by metal plating on the surface of the heat transfer substrate having a particle layer. The particles are separated in FIG. 2, however in the practical feature, the particles can be contacted each other or can be piled up so as to increase number of cavities (5). This feature is different from the feature shown in FIG. 1.

The preparation of the heat transfer surface of the present invention will be illustrated.

On the heat transfer surface (2) particles (such as particles made of a metal e.g. copper, nickel; an inorganic material e.g. glass or a polymer e.g. polystyrene) (7) having desired grain sizes in a desired range are piled up for desired particle layers (one layer in FIG. 2). The heat transfer surface (2) on which the particles (7) are placed is dipped in a metal plating solution to form a metallic film (8) such as a copper film by a copper plating whereby the particles (7) are held on the surface to form the porous layer (3). The porous surface (4) is prepared by the porous layer (3).

The composition and conditions of the metal plating solution are not limited and the conventional technology for the metal plating can be employed. For example, in the case of a copper plating, metal particles are filed for suitable steps as the particle layer on the surface of the substrate and they are dipped in an aqueous solution of copper sulfate and an electroplating is carried out in a current density of about $3A/dm^2$.

Figure 6:
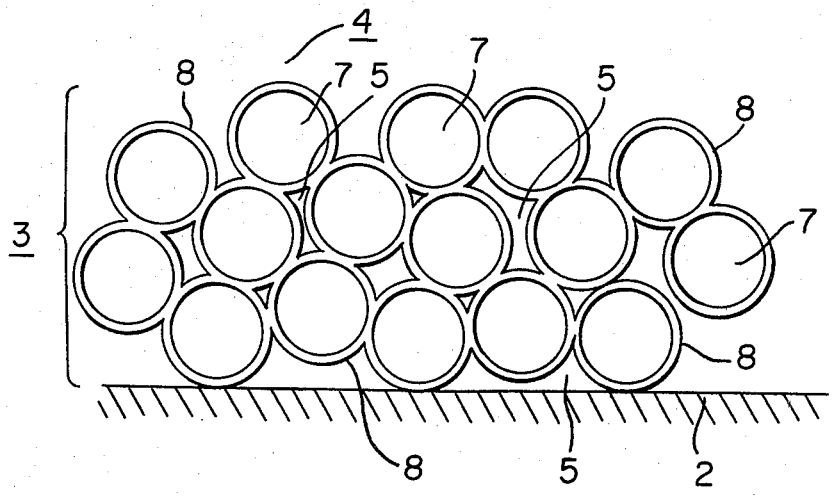
FIG. 6 is a porous heat transfer surface of the present invention.

FIG. 6 shows a schematic sectional view of the coated particle layer formed by piling the metal particles for certain steps and plating it with a metal.

It is also possible to form an other metallic film (such as nickel, (8) by the other metal plating (such as nickel plating) instead of the copper plating so as to hold the particles (7) on the surface of the heat transfer substrate (2). The porous surface (4) having the porous layer (3) which imparts the same effect can be obtained. It is preferable to use metallic particles having high thermal conductivity such as copper and silver particles as the particles (7) and to use a metal having high thermal conductivity such as copper and silver as the metallic film (8). When the particles having uniform grain size (such as spherical particles having uniform diameter) are used, the porous surface having uniform porous layer (3) can be obtained.

Figure 3:
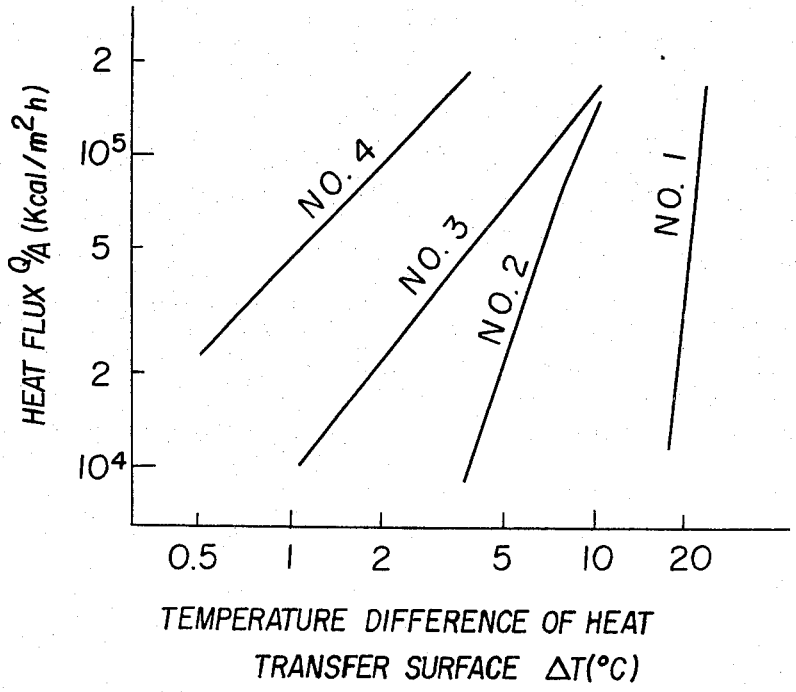
FIGS. 3 to 5 are respectively diagrams of boiling heat transfer characteristics of the porous heat transfer surface of the present invention.

FIG. 3 shows the boiling heat transfer characteristics of the heat transfer surface of the present invention.

The temperature difference between the heat transfer surface (2) and the liquid (6) is plotted on the abscissa and the heat flux is plotted on the ordinate. The numbers in FIG. 3 designate the data of the heat transfer surfaces shown in Table 1. No. 1 designates the data of the smooth surface. In Table 1, the grain size of 24–42 means the grains of 24 mesh pass and 42 mesh nonpass (Japanese Industrial Standard sieve). The thickness of the metallic film of 50 $\mu$m means the thickness of the metal formed by plating the metal on a smooth surface. In the process of the present invention, the metal plating is carried out over the particles whereby the area of the metal film formed by the plating is increased for the surfaces of the particles. Thus, the thickness of the metal film on the surfaces of the particle is remarkably less than 50 $\mu$m. The thickness of the metal film is about 7% of the diameters of the particles in one embodiment.

The metallic film is usually formed by an electric plating process and can be controlled by selecting a quantity of electricity and a time for current feed. It is understood that the heat transfer characteristics are superior depending upon the decrease of the grain size.

TABLE 1

| | metallic particle | | Metallic film | |
|---|---|---|---|---|
| No. | Type | Grain size (mesh) | Type | Thickness ($\mu$m) |
| 2 | Cu | 24–42 | Cu | 50 |
| 3 | Cu | 60–80 | Cu | 50 |
| 4 | Cu | 120–145 | Cu | 80 |

Figure 4:
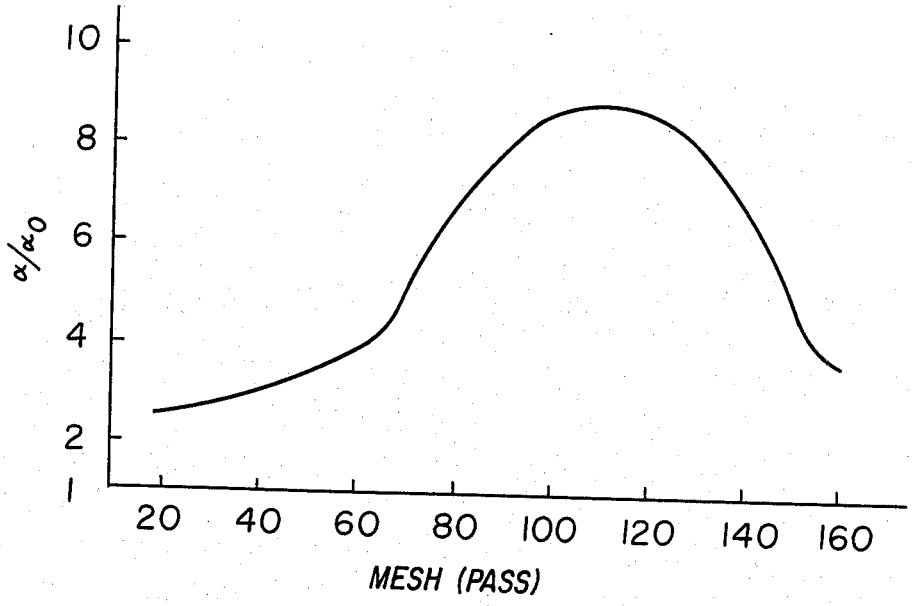

FIG. 4 shows the relation of increase of heat transfer coefficient by increase of mesh number. The mesh for the passed grain size is plotted on the abscissa. For example, 60 mesh means 60 mesh pass but nonpass of two step higher mesh as 80 mesh nonpass. The ratio of $\alpha/\alpha_o$ is plotted on the ordinate, wherein $\alpha_o$ designates the heat transfer coefficient of a smooth surface; and $\alpha$ designates the heat transfer coefficient of the porous surface of the heat transfer surface of the present invention.

FIGS. 3 and 4 show experimental results in the case using a fluorinated hydrocarbon (R-113) as the liquid coolant (6). The shape of the curve shown in FIG. 4 (such as the peak position) is varied depending upon the kind of the liquid coolant (6). However, the variation of the shape of the curve is remarkably small in the case using the fluorinated hydrocarbon type liquid coolant. (Freon) though the absolute value on the ordinate is varied.

The curve of FIG. 4 is not substantially varied by selecting metallic particles made of copper, nickel or iron and by varying the thickness of the metallic film (8) made of copper in a range of 10 $\mu$m to 100 $\mu$m. The thickness of the metallic film (8) should be greater than 10 $\mu$m in view of the mechanical strength required for fixing the particles on the heat transfer surface. This is found by many experiments.

As it is understood from the data in FIG. 4, the ratio $\alpha/\alpha_o \geqq 4$ is given in the range of the grain size of 60 mesh pass to 170 mesh pass (250 mesh nonpass).

Figure 5:
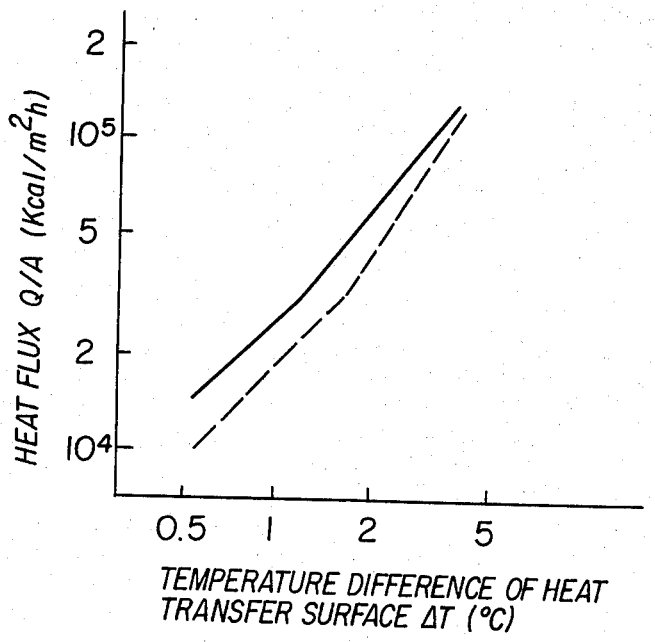

In FIG. 5, the broken line shows the boiling heat transfer characteristics of the porous heat transfer surface formed with the copper particles and the copper film in the liquid coolant (R-113) and the full line shows the boiling heat transfer characteristics of the porous heat transfer surface which is coated with nickel film by nickel plating on the copper film of the former one (the full line case).

The nickel film has excellent anticorrosive and antioxidation characteristics and impart improved heat transfer characteristics.

In the porous heat transfer surface of the present invention, it is possible to improve the anticorrosive and antioxidation characteristics and the heat transfer characteristics by selecting the kind of the metal plating as well as to improve the fixing of the particles on the surface.

We claim:

1. A boiling heat transfer surface for contacting with a liquid coolant, comprising a porous layer on a substrate, said porous layer formed of:

a layer of metallic particles having grain sizes of between 60 mesh pass and 250 mesh non-pass, said layer being at least one particle thick and defining interstices between said particles; and a metallic film plated on said particles and fixing said particles to one another and to said substrate, said metallic film having a substantially uniform thickness on each said particle greater than $10\mu$ but not sufficiently great to fill said interstices, whereby said interstices form at least some of the pores of said porous layer.

2. A boiling heat transfer surface according to claim 1 wherein the metallic film is made of nickel.

3. The surface of claim 1, wherein said plated metallic film is coated by dipping said layer of said metallic particles in a metallic plating solution.

* * * * *